US005360207A

United States Patent [19]

Rauen et al.

[11] Patent Number: 5,360,207

[45] Date of Patent: Nov. 1, 1994

[54] SMART PAPER TRAY FOR DETERMINING PAPER SIZE

[75] Inventors: David F. Rauen, Ontario; Mark Stevens, Henrietta, both of N.Y.

[73] Assignee: Xerox Corporation, Stamford, Conn.

[21] Appl. No.: 72,254

[22] Filed: Jun. 7, 1993

[51] Int. Cl.[5] ..... B65H 7/02; B65H 1/00

[52] U.S. Cl. ..... 271/265; 271/171

[58] Field of Search ..... 271/145, 171, 241, 144, 271/223, 265

[56] References Cited

U.S. PATENT DOCUMENTS

| | | | |
|---|---|---|---|
| 4,406,537 | 9/1983 | Mori | 271/145 |
| 5,031,116 | 7/1991 | Shukunami et al. | 355/311 |
| 5,045,880 | 9/1991 | Evanitsky et al. | 355/209 |
| 5,110,106 | 5/1992 | Matsumura et al. . | |
| 5,159,395 | 10/1992 | Farrell | 271/291 |

FOREIGN PATENT DOCUMENTS

| | | | |
|---|---|---|---|
| 0207335 | 11/1984 | Japan | 271/171 |
| 0061426 | 4/1985 | Japan | 271/171 |
| 0203033 | 9/1986 | Japan | 271/171 |
| 0185730 | 8/1988 | Japan | 271/171 |
| 0100930 | 4/1990 | Japan | 271/171 |

*Primary Examiner*—H. Grant Skaggs
*Attorney, Agent, or Firm*—Oliff & Berridge

[57] ABSTRACT

A smart paper tray determines paper size to enable maximization of throughput. The width and length of paper in the paper tray is determined by detectors mounted on slides contacting edges of the paper. The detectors can be linear or rotary encoders, potentiometers, etc. The detectors provide signals to a pitch controller and/or instructor. The pitch controller controls pitch of the printing apparatus on the basis of the signals such that the pitch is maximized to enable maximum throughput of the printing apparatus. The instructor instructs an operator on the basis of the signals how to load the paper to achieve maximum throughput.

7 Claims, 5 Drawing Sheets

SMART PAPER TRAY FOR DETERMINING PAPER SIZE

BACKGROUND OF THE INVENTION

1. Field of the Invention

The present invention relates to a smart paper tray and, more particularly, to a smart paper tray which enables the determination of the size of paper loaded into the tray.

2. Description of the Related Art

Printing apparatus commonly use a plurality of paper trays to enable printing on different sizes of paper. In order to enhance productivity of the apparatus, it is desired to know exactly the size paper present in the paper tray to enhance the printing operation on the paper. By knowing what size paper is present in the paper tray, throughput of the printing apparatus can be maximized to, for example, reduce the time required for a printing operation. Accordingly, a printing apparatus having the ability to know exactly what size paper is present can enhance the maximum pitches used in the apparatus.

In the past, this has been achieved by using a series of switches and the logic of on/off switch positions to detect the presence of common paper sizes.

U.S. Pat. No. 5,110,106 to Matsumura et al. discloses one such sheet size detector. A plurality of detectors SA1 through SA4 and SB1 through SB3 are arranged at predetermined intervals along respective moving paths of cams. When a sheet contained in a sheet feed tray is biased by sheet guides, the detecting means located at the position where the sheet guides are stopped are operated to transmit sheet size signals representing sheet size range increments. Microswitches are used as the detecting means. Sheet size can only be determined in accordance with the predetermined location of the switches. Accordingly, only sheet size range increments can be determined. The apparatus does not determine specific sheet sizes since the switches are not mounted on slides contacting the paper edges. The reference even acknowledges that the device is not dedicated to accurately detecting a single sheet size, but rather detects a size range increment including a range of individual sheet sizes (see column 6, lines 3–7).

Accordingly, it would be desirable to enable determination of specific paper sizes present in a paper tray by accurately determining the width and the length of the paper. In accordance with such a determination, the logic of the printing apparatus can run the paper in a mode enhancing the maximum pitches to add maximum throughput.

SUMMARY OF THE INVENTION

The smart paper tray of the present invention determines paper size to enable maximization of throughput. The width and length of paper in the paper tray are determined by detectors mounted on slides contacting the edges of the paper. The detectors provide signals enabling maximization of the pitch and corresponding maximization of throughput of a printing apparatus in which the paper tray is mounted. Signals provided by the detectors can also enable an operator to be instructed how to load the paper to achieve maximum throughput.

BRIEF DESCRIPTION OF THE DRAWINGS

The invention will be described with reference to the following figures, wherein.

DETAILED DESCRIPTION OF THE PREFERRED EMBODIMENTS

In most paper trays, a backstop is provided on sides opposite a registration corner of the tray. The backstops generally comprise slides which an operator slides to contact the paper stack. The slides prevent offset of the stack of paper in the tray.

Figure 1:
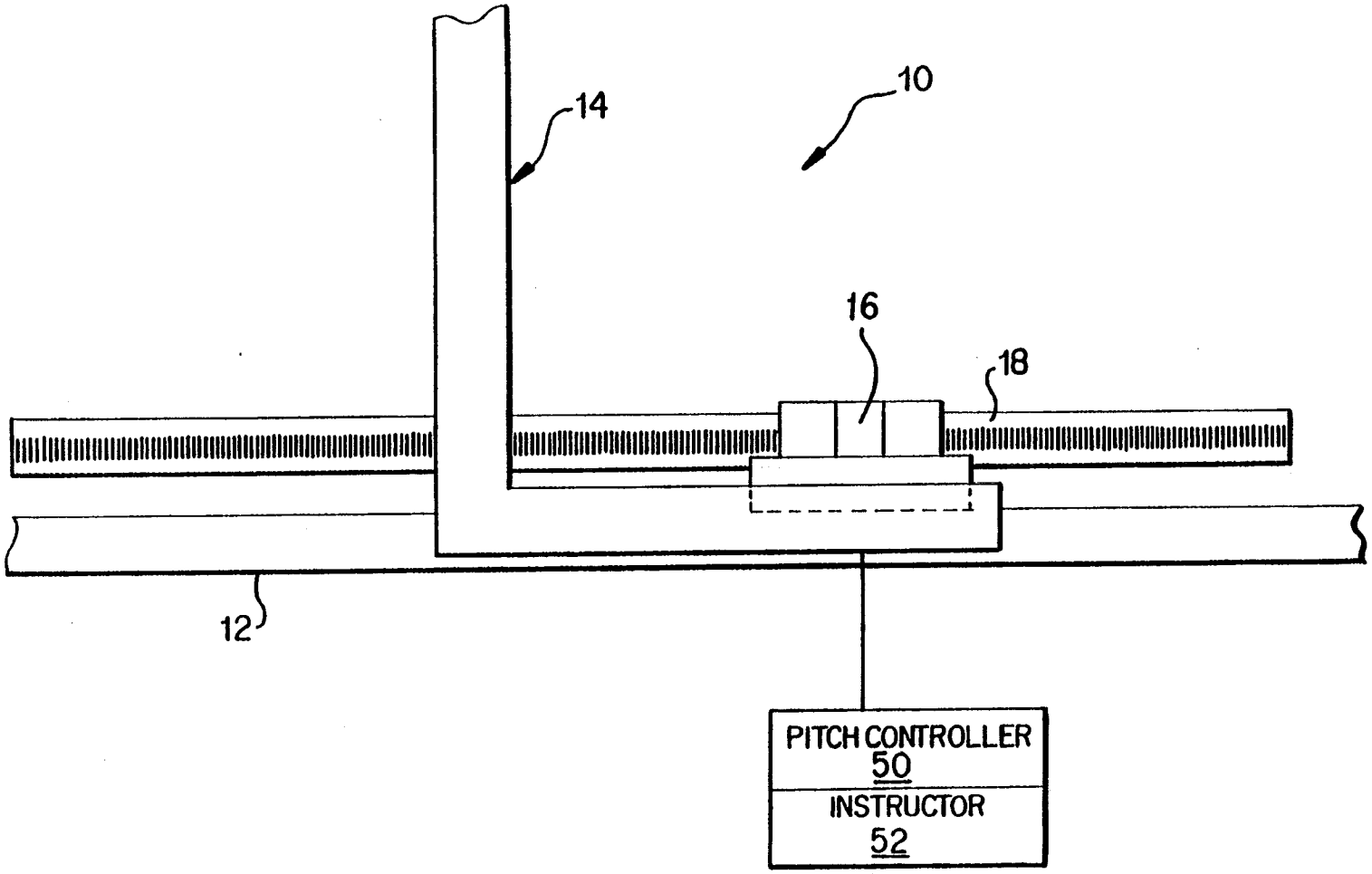
FIG. 1 illustrates a first paper tray embodiment of the present invention.

The present invention incorporates a readout device attached to the slide, the readout device providing a location signal for processing by a printing apparatus in which the paper tray is mounted. As illustrated in FIG. 1, one embodiment of the device according to the present invention is shown. In the FIG. 1 embodiment, the device 10 includes a paper tray 12 in which paper is stacked. A slide 14 is slidably moved by an operator to contact edges of the paper stack. An encoder such as a linear encoder 16 is mounted on the slide 14. As the slide 14 is slidably moved, a signal is provided as the linear encoder 16 mounted on slide 14 moves past a plurality of lines 18. In accordance with movement of the linear encoder 16 past the lines 18, the device 10 provides an indication of the dimension of the paper provided in the paper tray.

A readout device such as linear encoder 16 can be mounted on each of two slides contacting the widthwise and lengthwise edges of the paper. Accordingly, an accurate determination can be made of both dimensions of the paper present in the tray.

Once the dimensions of the paper provided in the paper tray are known, the pitch of the printing apparatus can be controlled by a pitch controller 50 to enable maximum throughput of the processor. Accordingly, the time necessary for an operation of the apparatus can be reduced. Further, materials necessary for an operation can also be reduced. The determination of paper size is performed automatically without requiring an operator entry to the apparatus controller, thus preventing possible operator error. Multipitch can be enhanced to its fullest potential with little or no operator intervention.

In accordance with the present invention, the device 10 of the present invention can also facilitate maximum throughput by instructing an operator by an instructor 52 how to load the paper to obtain the most productive process direction. Thus, an operator can be automatically instructed on the most advantageous orientation of paper in the paper tray (i.e., short edge feed or long edge feed). Accordingly, maximum throughput can further be enhanced by use of the present invention.

The mounting of the readout device on the slide further enables a manufacturing and field adjustment for rezeroing of the registration of the paper stack.

Figure 2:
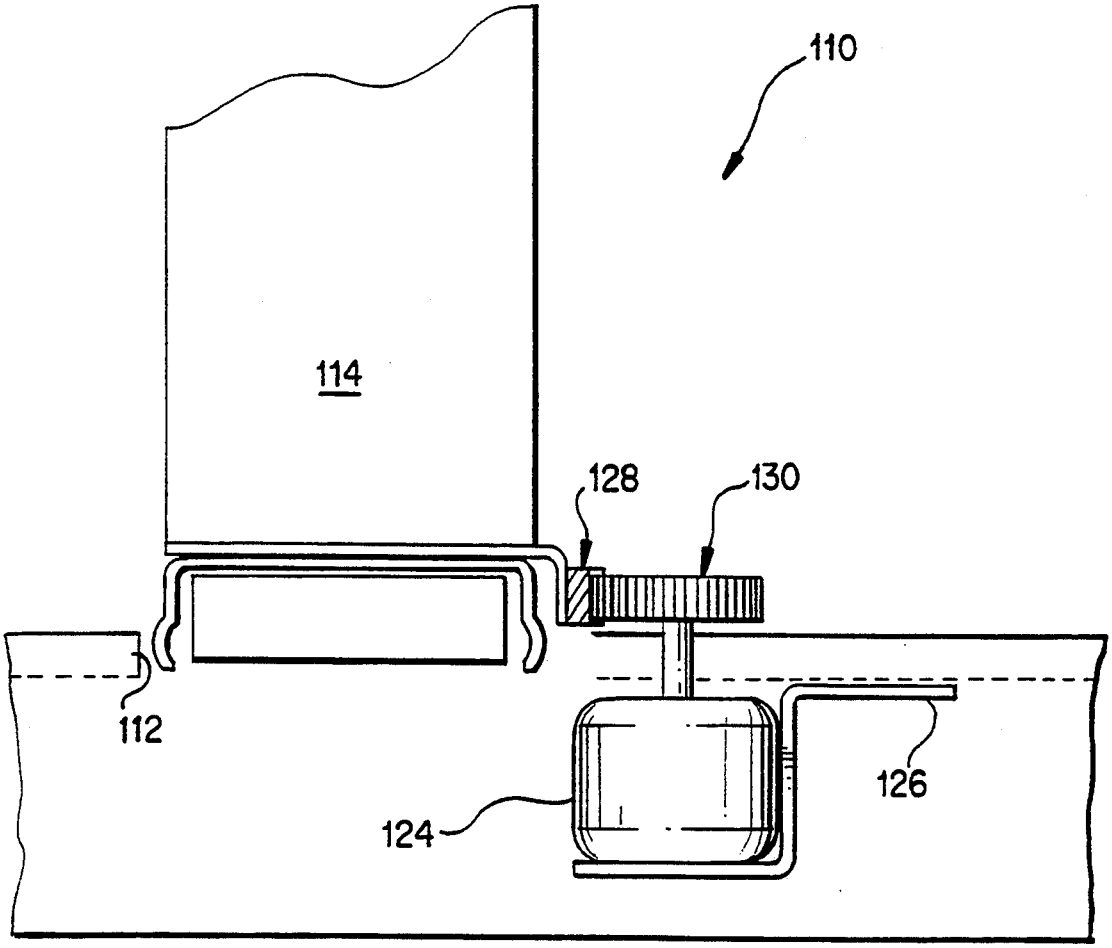
FIG. 2 illustrates a second paper tray embodiment of the present invention.

FIG. 2 illustrates another embodiment of a device 110 according to the present invention. In the FIG. 2 embodiment, a readout device such as a rotary encoder 124 is mounted on a slide 114 contacting paper in tray 112. As the slide 114 is moved to contact the paper edges, relative movement between a rack 128 and pinion 130 cause rotation of rotary encoder 124 supported by bracket 126. In accordance with rotation of rotary encoder 124, a signal can be provided in a similar manner as the FIG. 1 embodiment, the signal indicating location of the slide and, consequently, the dimension of the paper contacted by the slide.

Figure 3:
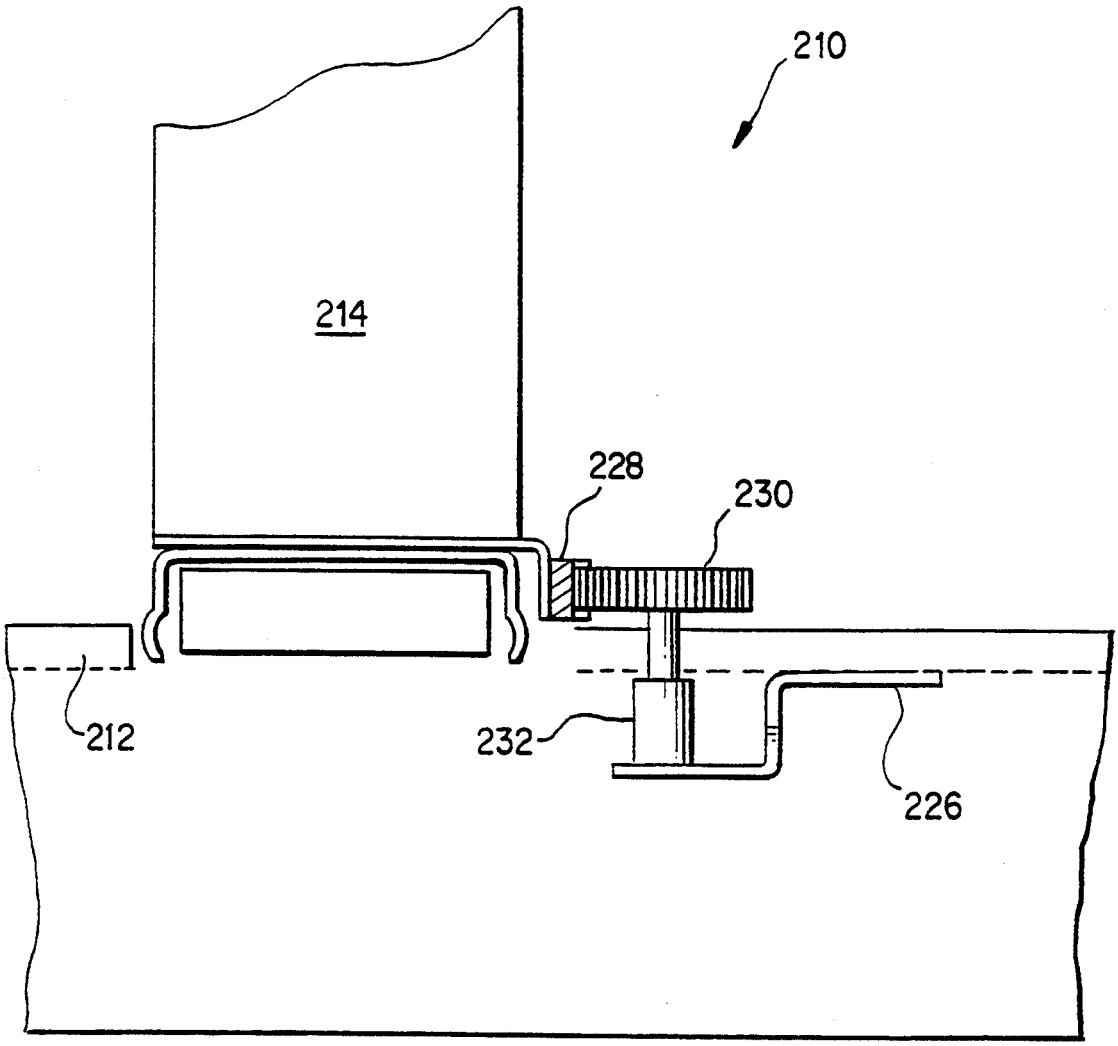
FIG. 3 illustrates a third paper tray embodiment of the present invention.

FIG. 3 illustrates a third embodiment of a device 210 according to the present invention. This embodiment is similar to the second preferred embodiment, except a potentiometer 232 is used as a readout device. The potentiometer 232 is mounted on a slide 214 contacting paper in tray 212. As the slide 214 is moved to contact the paper edges, relative movement between a rack 228 and pinion 230 cause rotation of the potentiometer 232 that is supported by bracket 226. By measuring the unknown voltage in the potentiometer and comparing that voltage to a known voltage, the amount of movement by the pinion 230 can be determined. Similar to the previous embodiment, a signal generated by the potentiometer 232 indicates the location of the slide and, consequently, the dimension of the paper contacted by the slide.

Figure 4:
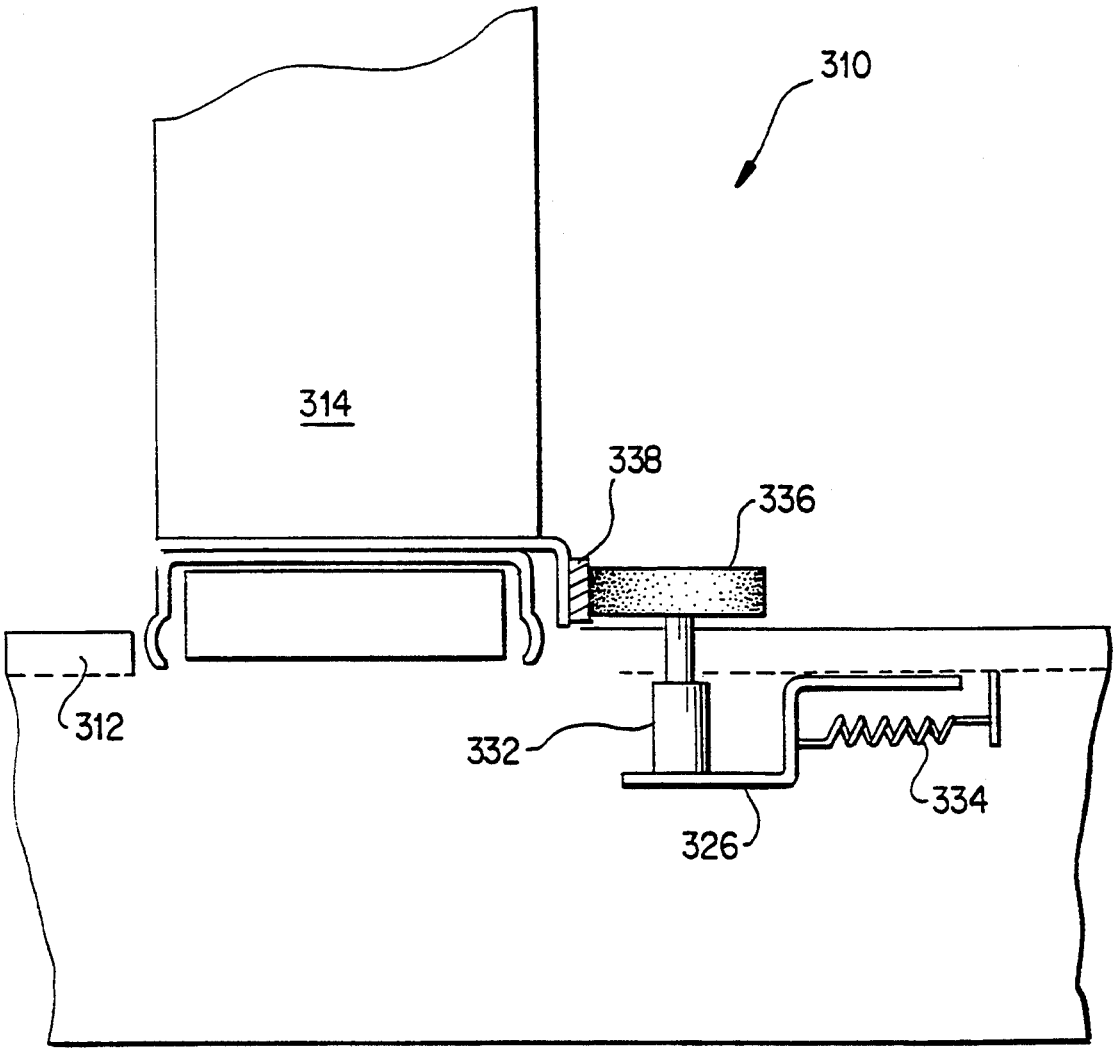
FIG. 4 illustrates a fourth paper tray embodiment of the present invention.

FIG. 4 illustrates fourth embodiment of a device 310 according to the present invention. This embodiment includes a potentiometer 332 coupled to a high micro-wheel 336. A spring 334 is used to apply pressure against the bracket 326, which supports the potentiometer 332. The micro-wheel 336 is kept in contact with a frictional surface 338 of the slide 314 by the force of the spring 334. As in the previous embodiments, a slide 314 moves in contact with the edge of the paper that is held in the paper tray 312. The signal generated by the potentiometer 332 indicates the dimension of the paper in the tray.

Figure 5:
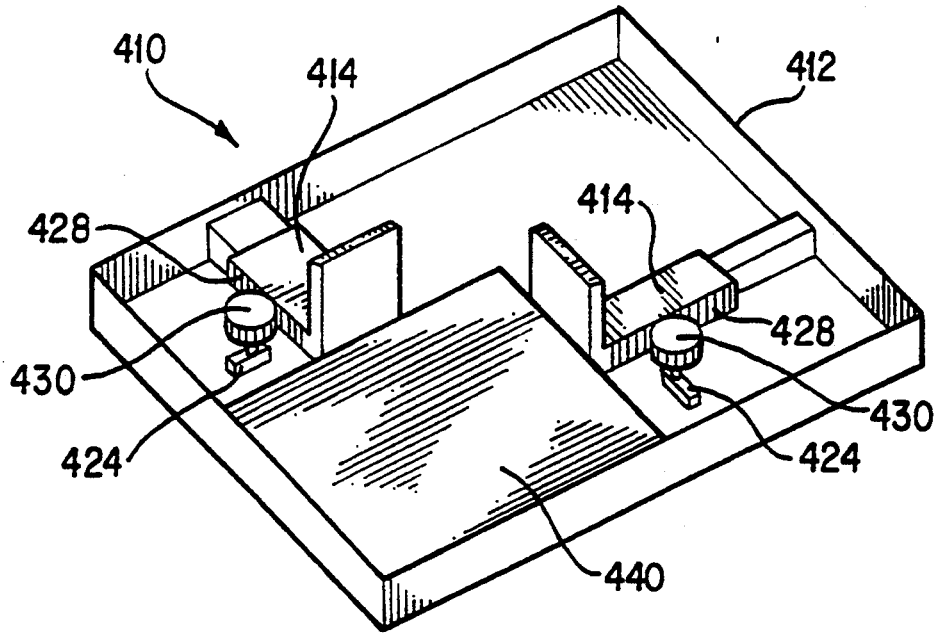
FIG. 5 illustrates a schematic representation of a fifth paper tray embodiment of the present invention.

FIG. 5 illustrates a fifth embodiment of a device 410 according to the invention. In the FIG. 5, paper 440 is stacked in tray 412. Two slides 414 are adjusted to be in contact with paper 440. Relative movement between rack 428 and pinion 430 causes a rotation of the rotary encoder 424, which produces a signal in a similar manner as in the first embodiment. The signal indicates the location of the slide 414 and, consequently, the exact dimension of the paper contacted by the slides 414.

Figure 6:
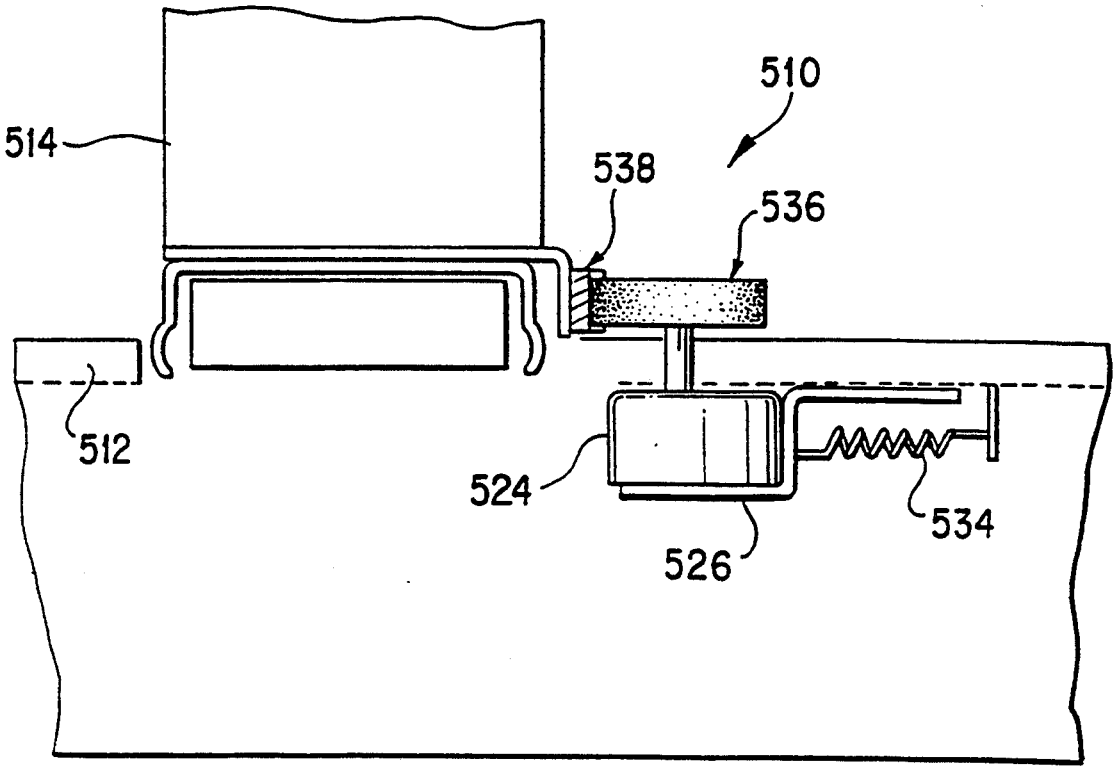
FIG. 6 illustrates a sixth paper tray embodiment of the present invention.

FIG. 6 illustrates a sixth embodiment of the device according to the present invention. This embodiment is similar to the fourth embodiment of the invention. A rotary encoder 524 is coupled to a high micro-wheel 536. A spring 534 is used to apply pressure against the bracket 526, which supports rotary encoder 524. The micro-wheel is kept in contact with the frictional surface 538 of the slide 514 by the force of spring 534. As in the previous embodiments, a slide 514 moves in contact with the edge of the paper held in the paper tray 512. The signal generated by the rotary encoder 524 indicates the dimension of the paper in the tray.

While the present invention is described in conjunction with linear and rotary encoders 16 and 124, various other types of readout devices can be used such as devices that provide feedback signals to the apparatus controller, etc.

In accordance with the present invention, the size of paper present in the paper tray can be known at all times. Thus, the paper can be processed in a mode enhancing throughput of the device. The readout devices are low in cost, while accurately determining paper dimensions. The apparatus further requires little or no operator intervention, thus minimizing possible operator error.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A printing apparatus including a smart paper tray for determining paper size, comprising:

a tray for receipt of paper;

at least one slide for contacting at least one edge of the paper;

a detector attached to the at least one slide, the detector sensing at least one dimension of the paper, the detector comprising a rotary encoder that is connected to a micro-wheel, and a spring applying force to keep the micro-wheel in contact with a frictional surface of the at least one slide; and a pitch controller for controlling a pitch between leading edges of the paper passing through the printing apparatus, the pitch controller responding to a signal from the detector to determine the appropriate pitch to enable maximum throughput of the printing apparatus.

2. The apparatus according to claim 1, wherein the at least one slide comprises two slides, one of the slides including a first detector for sensing paper width and the other of the slides including a second detector for sensing paper length.

3. The apparatus according to claim 1, further comprising an instructor for determining the best direction to load the paper into the tray to minimize the pitch between leading edges of the paper based on the pitch controller, and for instructing an operator how to load the paper in the tray to achieve maximum throughput.

4. The apparatus according to claim 1, further comprising determining means for determining the best direction for the paper in the tray to achieve maximum throughput based on a signal from the pitch controller, and for informing the operator to change the direction of the paper if a current direction of the paper is unable to achieve maximum throughput.

5. A printing apparatus including a smart paper tray for determining paper size, comprising:

a tray for receipt of paper;

at least one slide for contacting at least one edge of the paper;

a detector attached to the at least one slide, the detector sensing at least one dimension of the paper, the detector comprising a potentiometer connected to a micro-wheel, and a spring applying force to keep the micro-wheel in contact with the frictional surface of the at least one slide; and a pitch controller for controlling a pitch between leading edges of the paper passing through the printing apparatus, the pitch controller responding to a signal from the detector to determine the appropriate pitch to enable maximum throughput of the printing apparatus.

6. The apparatus of claim 5, wherein the at least one slide comprises two slides, the first slide including a first detector for sensing paper width and the second slide including a second detector for sensing paper length.

7. The apparatus according to claim 5, further comprising determining means for determining the best direction for the paper in the tray to achieve maximum throughput based on a signal from the pitch controller, and for informing the operator to change the direction of the paper if a current direction of the paper is unable to achieve maximum throughput.

* * * * *